United States Patent [19]

Fath

[11] Patent Number: 5,074,038

[45] Date of Patent: Dec. 24, 1991

[54] CABLE MAKING MACHINE AND METHOD OF MANUFACTURE

[75] Inventor: Scott A. Fath, Glen Allen, Va.

[73] Assignee: AMP Incorporated, Harrisburg, Pa.

[21] Appl. No.: 647,107

[22] Filed: Jan. 25, 1991

[51] Int. Cl.[5] ..... H01R 43/04

[52] U.S. Cl. ..... 29/861; 29/857; 29/753; 29/33 M; 29/564.6

[58] Field of Search ..... 29/33 M, 564.1, 564.6, 29/749, 753, 759, 857, 863, 865, 866

[56] References Cited

U.S. PATENT DOCUMENTS

| | | | |
|---|---|---|---|
| 4,359,257 | 11/1982 | Lopinski et al. | 339/99 R |
| 4,419,817 | 12/1983 | Funcik et al. | 29/857 |
| 4,839,962 | 6/1989 | Long, Jr. | 29/753 |
| 4,841,631 | 6/1989 | Selby | 29/749 |
| 4,870,752 | 10/1989 | Brown et al. | 29/866 |
| 4,908,941 | 3/1990 | Fukuda et al. | 29/857 |

*Primary Examiner*—P. W. Echols

[57] ABSTRACT

Cable making machine has first and second modules which contain connectors and which are movable along a cable feed path that extends past a connector installing press. Cable is fed by feed rolls to the first module along the feed path. A cable clamp is provided between the modules for pulling cable from a cable source during operation. A deflector is provided for feeding cable in a manner which forms a loop between the first and second modules. The machine is relatively compact and is capable of producing relatively long cable assemblies.

14 Claims, 13 Drawing Sheets

140
144
142
34
52
40
28
84
20
134
33
11
11

CABLE MAKING MACHINE AND METHOD OF MANUFACTURE

FIELD OF THE INVENTION

This invention relates to cable making machines of the type in which flat cable is fed from a reel along a cable feed path which extends through aligned connectors and the connectors are installed on the cable at an installing station which is on the feed path.

BACKGROUND OF THE INVENTION

U.S. Pat. Nos. 4,870,752 and 4,359,257 (which are incorporated herein by reference) disclose a cable making machine in which cable is fed from a reel through at least two stacked connectors which are in alignment with each other. The first connector in the stack is installed on the cable at an installing station and then moved downstream, relative to the direction of cable feeding, after installation so that the next adjacent connector can be installed.

The present invention is directed to the achievement of improvements to the general type of cable making machine described and disclosed in the above-identified U.S. patents. Particularly, the invention is directed to the achievement of an improved arrangement for locating the trailing end of the cable in the last connector on the cable and to improvements which permit an increase in the length of cable which is between two adjacent connectors in the finished cable assembly.

THE INVENTION

The invention comprises a means for manufacturing electrical cable assemblies, each cable assembly comprising a plurality of electrical connectors which are installed on an electrical cable of the type comprising a plurality of parallel side-by-side coplanar conductors. The machine comprises cable feeding means for feeding cable from an endless source along a cable feed path, cable severing means, a plurality of connector holders or modules, and an installing station. The severing means and the connector installing station are on the feed path at fixed locations with the installing station downstream, relative to the direction of cable feeding, from the severing means. The connector holders are in alignment with each other on the feed path and are movable between upstream and downstream positions with respect to the installing station. The machine is characterized in that a normally open cable clamp is provided on the feed path between two adjacent connector holders, the cable clamp being movable between an upstream initial position and a downstream intermediate position with respect to the installing station. The cable clamp is also movable downstream from its intermediate position to a final position which is spaced from the intermediate position by a distance which is substantially equal to the distance between the severing means and the installing station. In use, connectors in the connector holders can be installed on the cable by moving the connector holders in succession from their upstream positions to the installing station. When the last connector holder is at the installing station, the severing means is activated to cut the cable and the cable clamp is closed and moved to its downstream final position so that the cable is pulled in a downstream direction thereby to locate the cut end of the cable in the connector which is in the final or last connector holder.

Advantageously, at least one cable deflector is provided at a location downstream from and adjacent to, the installing station. The deflector is movable laterally of the cable feed path between a cable deflecting position and a non-deflecting position. The deflector is in deflective relationship to the cable feed path when in its deflecting position so that cable being fed to the feeding means is deflected laterally of the feed path whereby the length of the cable between two adjacent connectors in the assembly is increased.

In accordance with the method aspect of the invention, the cable assemblies are manufactured by a method comprising the steps of feeding cable from an endless source along a cable feed path which extends through the second of two connectors, through an open cable clamp, and into the first connector of two connectors on the cable feed path, the first connector being positioned in a stationary connector applicator. The first connector is installed on the cable by the connector applicator and is thereafter moved downstream to a first connector dwell location while cable is supplied from the source so that the cable is pulled through the second connector and past the connector applicator. The cable clamp is moved downstream along the cable feed path to a cable clamp dwell location which is between the first connector and the connector applicator. The second connector is moved downstream along the cable feed path to the connector applicator and the cable is cut and the clamp closed onto the cable. The cable clamp is then moved downstream by an amount which will pull the cut end of the cable into the second connector and the second connector is installed on the severed end of the cable by the cable applicator. After the first connector has been moved to the first connector dwell location and the cable clamp has been moved to the cable clamp dwell location, additional cable can be fed from the endless source so that a loop is produced between the first connector and the cable clamp and the length of the completed cable assembly thereby increased.

THE DRAWING FIGURES

Figure 13:
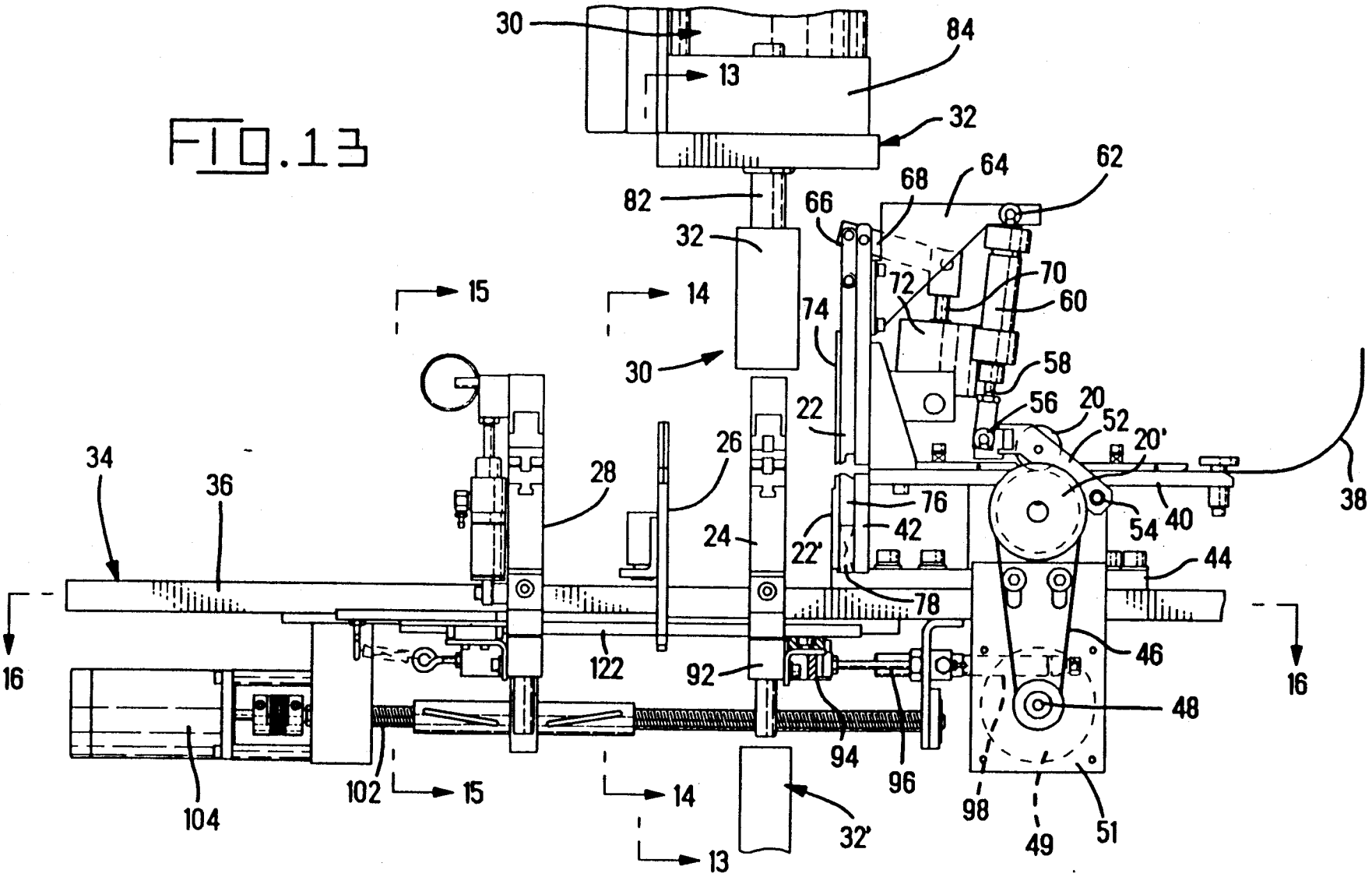
FIG. 13 is a view similar to FIG. 12 but having a cover plate removed.

FIGS. 14, 15, 16, and 17 are sectional views looking in the directions of the correspondingly numbered arrows in FIG. 13, some parts being omitted in some of these views.

THE DISCLOSED EMBODIMENT

Figures 1, 2:
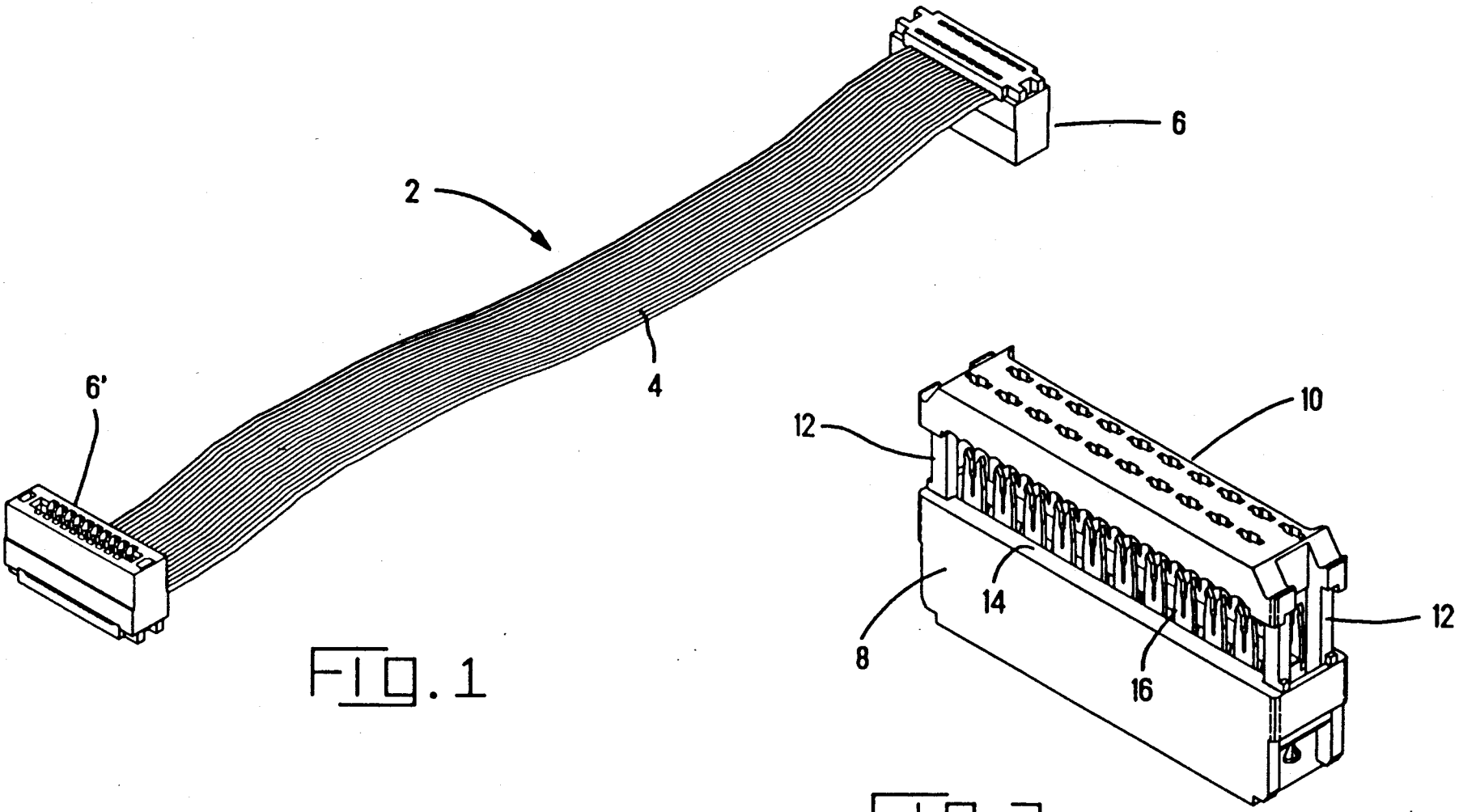
FIG. 1 is a perspective view of a typical cable assembly manufactured by a machine and by the method of the present invention.
FIG. 2 is a perspective view of a connector prior to installation on a cable.

FIG. 1 shows a typical cable assembly 2 which is produced by the practice of the invention. The cable assembly 2 comprises a length of ribbon cable 4 which in turn comprises a plurality of side-by-side parallel coplanar conductors encased in insulating material. A first connector 6 is installed on the cable at the leading end and a second connector 6' is installed on the trailing end. The connectors 6, 6' are of the type described in U.S. Pat. Nos. 4,870,752 and 4,359,257 and need be described only briefly for purposes of the present description. Each connector, FIG. 2, comprises a prismatic body 8 and a cover 10, which is above the body portion prior to installation, and which has depending latch arms 12. The body portion has a cable receiving face 14 which is opposed to the underside of the cover and terminals 16 extend from this cable receiving face. Each terminal has a wire receiving slot so that when the cable is located between the underside of the cover and the upper ends of the cover or terminals and the cover is then moved downwardly to its closed position, the conductors in the cable will be moved into the wire receiving slots of the terminals.

FIGS. 3-8 illustrate the principles of the invention with the important elements of a machine in accordance with the invention shown diagrammatically. The machine comprises feed rolls 20, 20' which feed the cable from a spool 18 or other endless source along a feed path. The feed path extends through normally open severing blades 22, 22', through a second connector holder or module 24 which contains a second connector 6', through a normally open clamp 26, and through a first connector holder 28 which contains the first connector 6. The first module 28 is located in a fixed connector installing station 30 which comprises rams 32, 32' which are above and below the module 28 and which move relatively towards each other to compress the module and thereby move the cover member 10 of the connector in the connector holder into its closed or fully assembled position.

In the diagrammatic views, FIGS. 3-8, the modules 24, 28 and the clamp 26 are shown as being exploded from each other along the cable feed path at the beginning of the operating cycle. In the machine, these parts are stacked against each other as will be described below.

Figure 3:
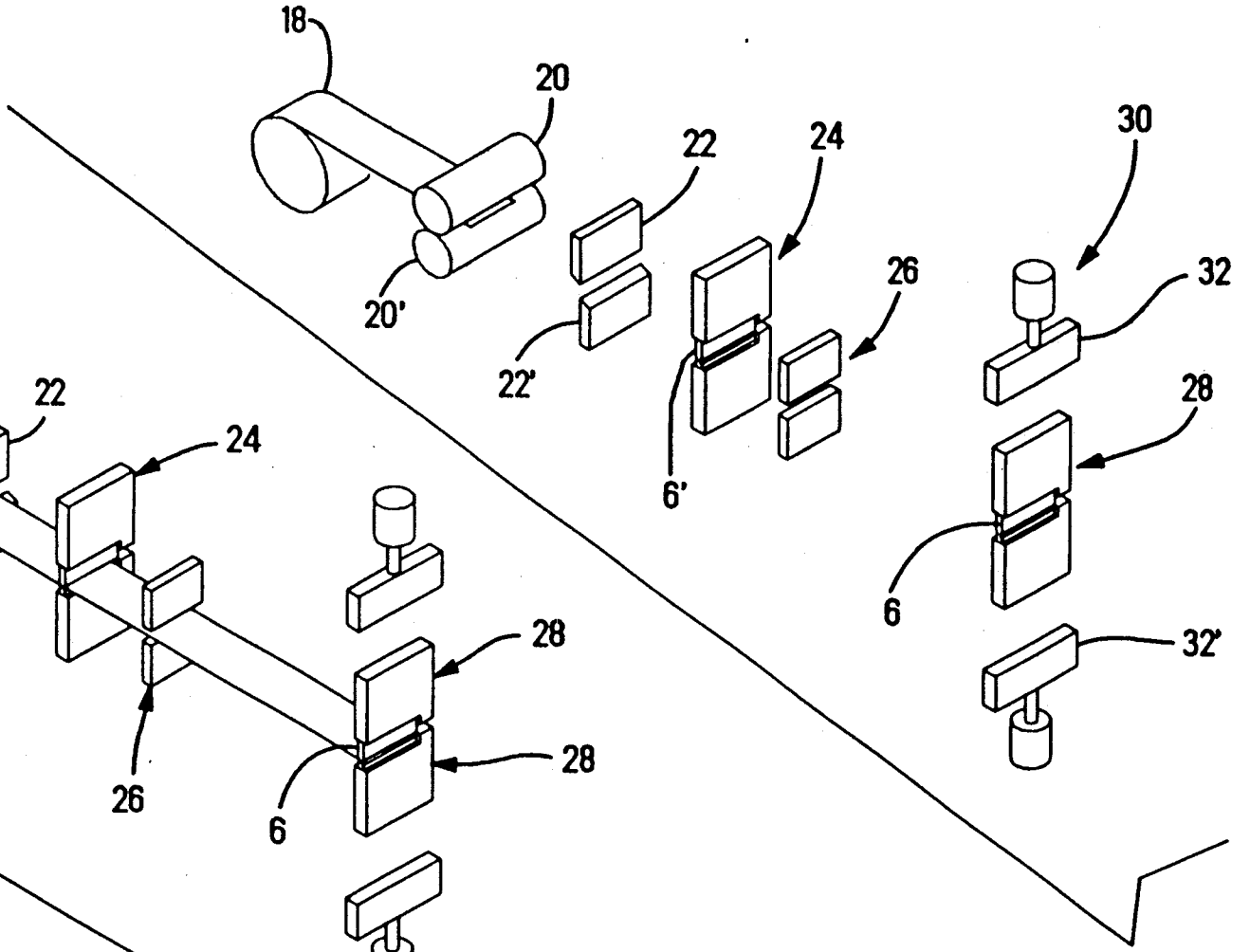
FIG. 3 is a diagrammatic view which shows the principal parts or elements of a machine in accordance with an invention, this view showing the positions of the parts at the beginning of an operating cycle.
Figure 4:
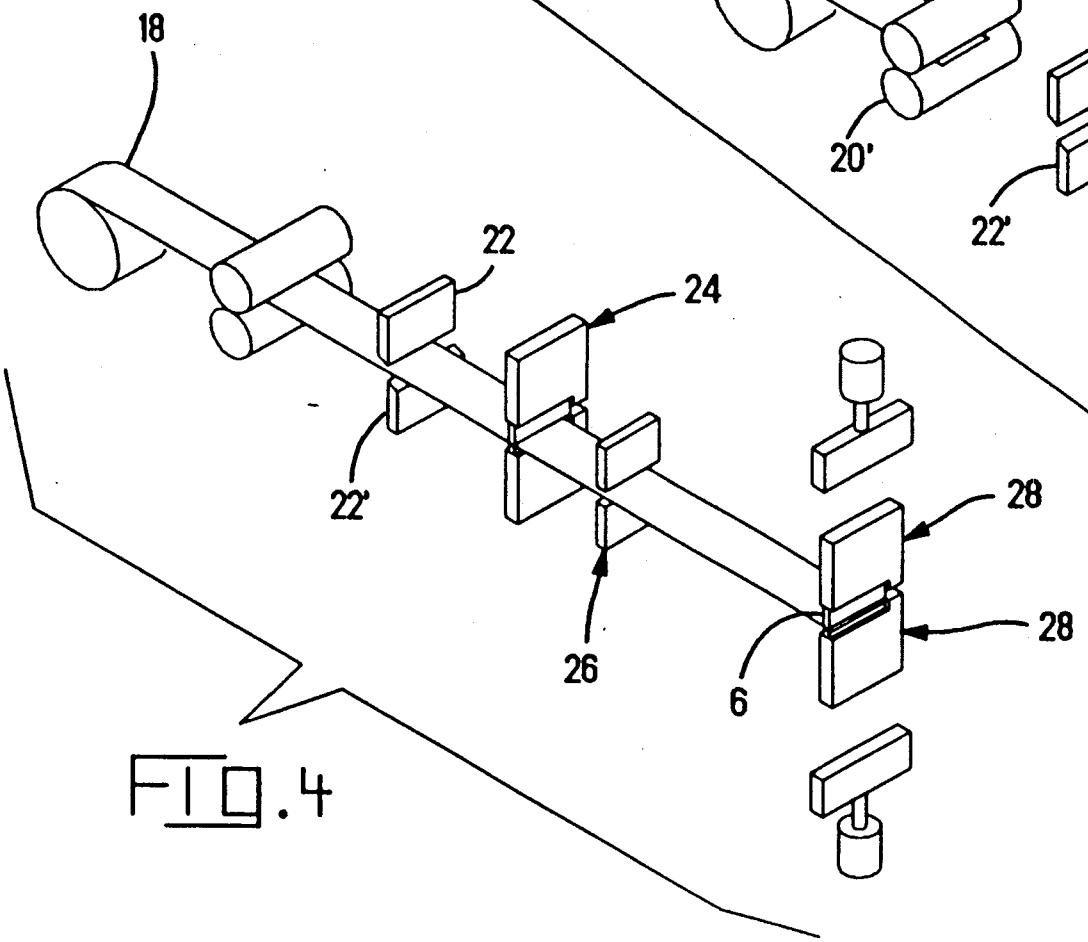
FIGS. 4–8 show the movement of the parts and illustrate the operations performed during a complete operating cycle.
Figure 5:
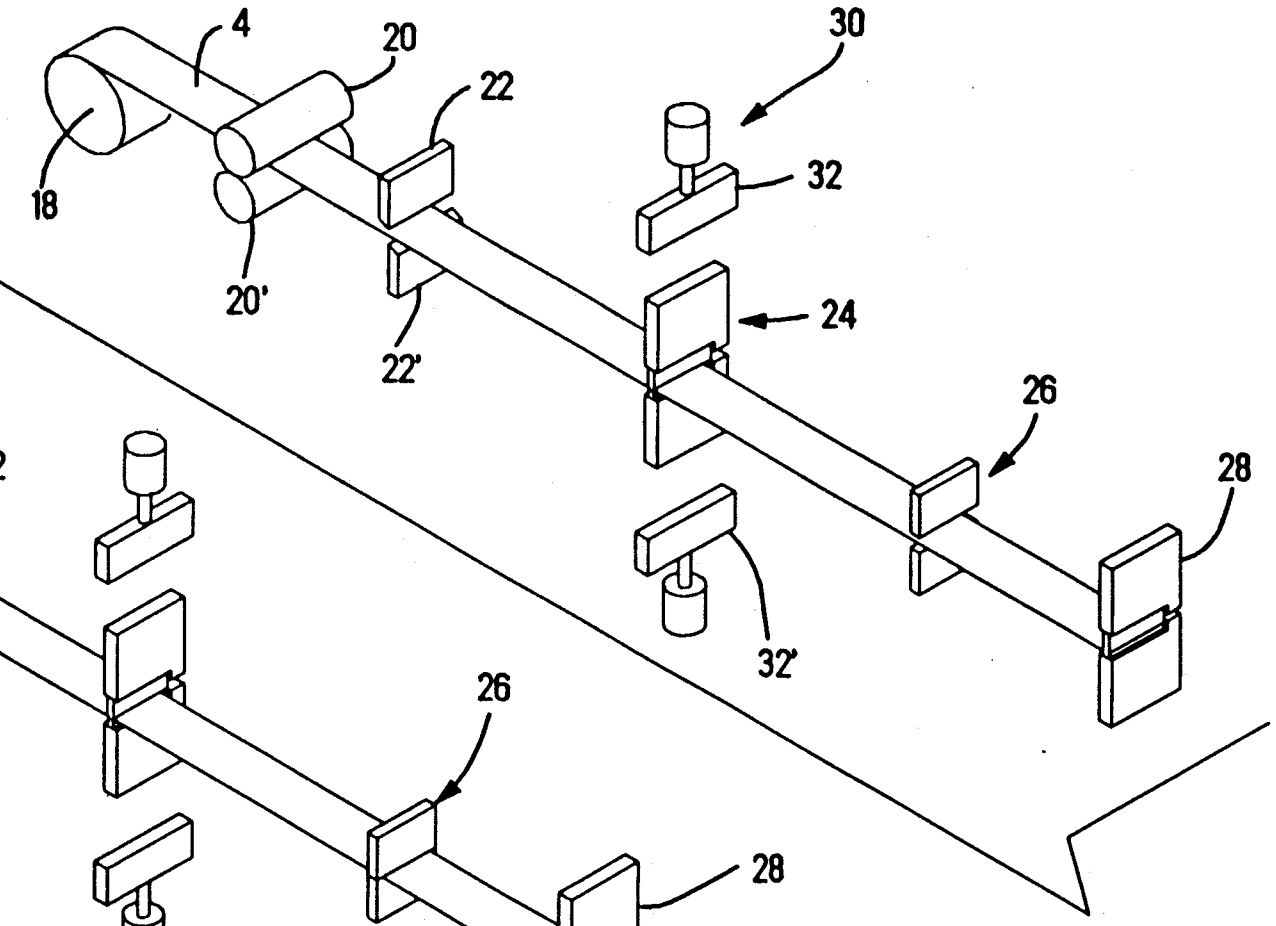
Figure 6:
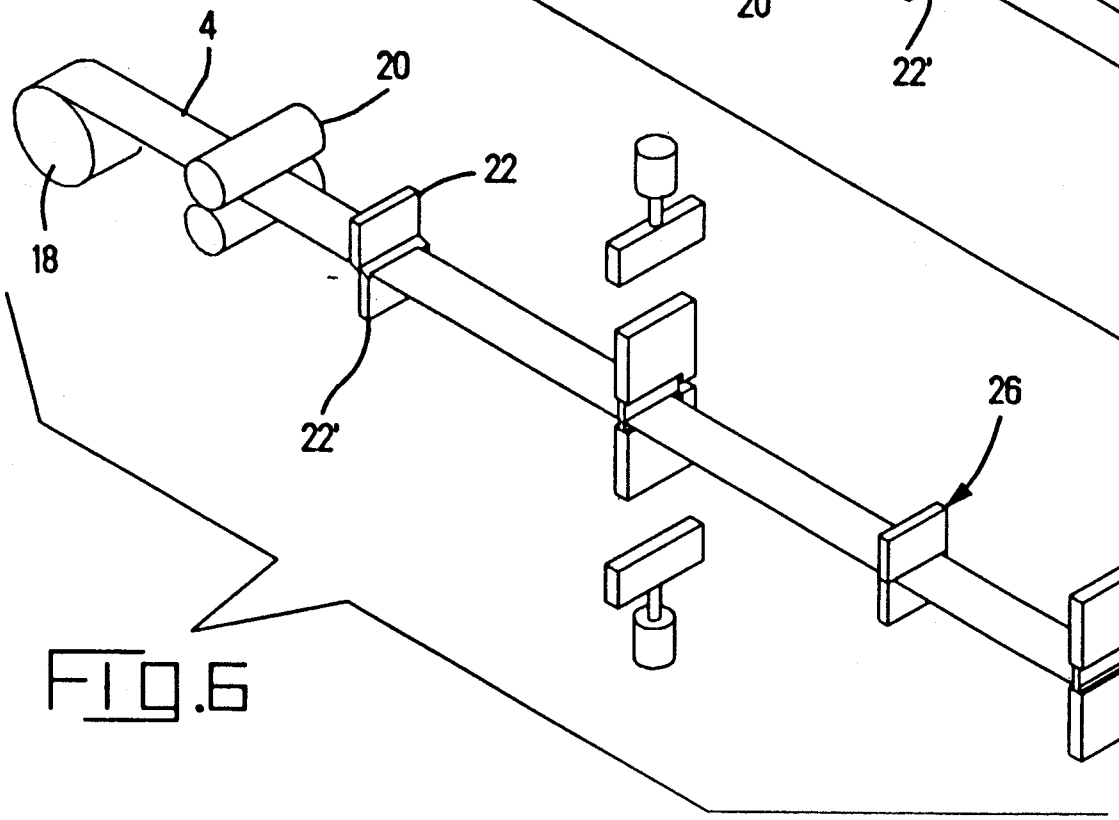
Figure 7:
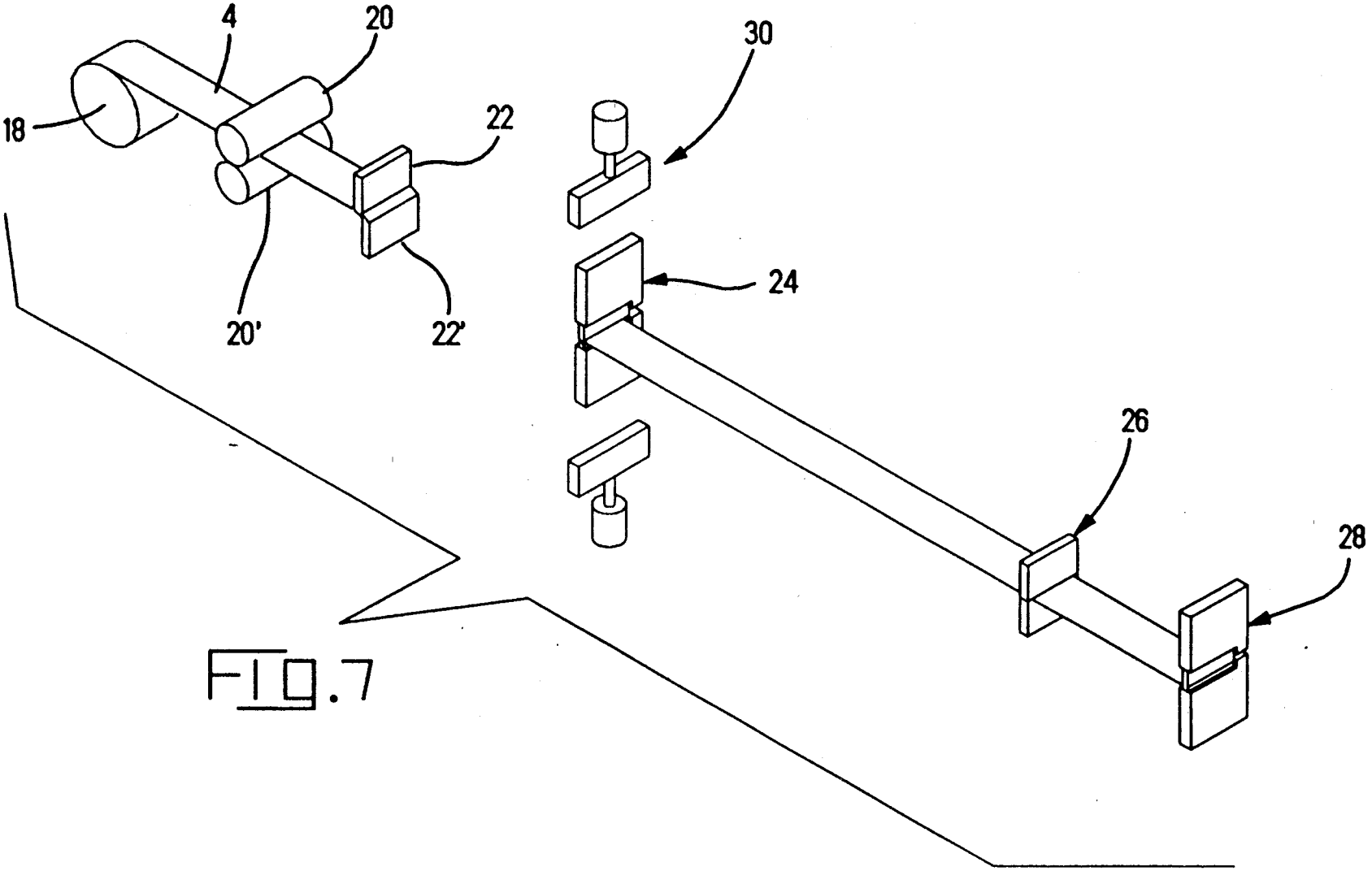
Figures 8, 9:
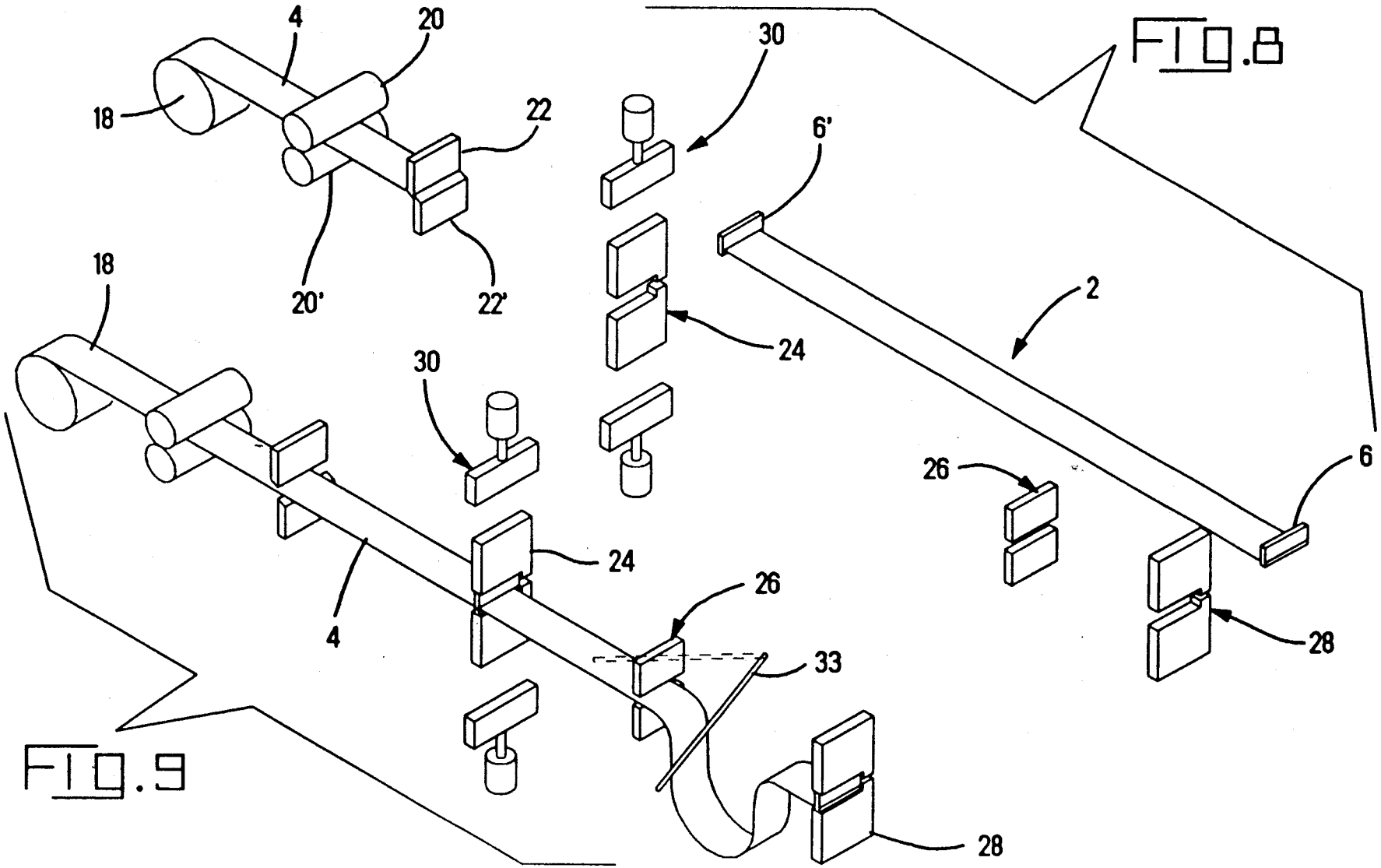
FIG. 9 shows a modified operating cycle in which the length of cable is increased.

At the beginning of the operating cycle, the parts will be in the positions of FIG. 3 with the end of the cable extending from the feed rolls 20, 20'. The feed rolls are first rotated to feed the cable along the cable feed path as shown in FIG. 4 until the end of the cable extends at least to the connector which is contained in the module 28. Thereafter, the rams 32 at the installing station 30 are moved towards each other to install the first connector in the first module 28 on the cable. The first module 28 and the cable clamp 26, which is in its open condition, are then moved downstream relative to the direction of cable feeding to the positions shown in FIG. 5 and the second module 24 is moved to the installing station 30. The cable 4 is then severed by the severing blades 22, 22' as shown in FIG. 6 and the clamp 26 is closed. The clamp is thereafter moved downstream a distance equal to the distance between the severing blades 22, 22' and the installing station 30 so that the cut end of the cable is positioned in the connector 6' which is in the second module 24. The second connector can then be installed on the trailing end of the cable by the rams as shown in FIG. 7. The clamp 26 and the modules or connector holders 24, 28 are then opened and the finished harness is ejected rightwardly as shown in FIG. 8. Thereafter, additional connectors are loaded into the modules for the next operating cycle by loading mechanisms and the parts are returned to the relative positions of FIG. 3; that is, the second module and the clamp are moved to positions upstream from the installing station and the first module is moved to the installing station.

FIG. 9 shows an embodiment in which the length of the cable assembly is increased by the use of a cable deflector 33. The deflector 33 is movable between a non-deflecting position, shown in phantom lines, and a deflecting position shown in solid lines. When the cable is in its deflecting position, cable can be fed by the feed rolls along the feed path through the open severing blades, through the connector at the installing station, and through the open clamp. The cable will encounter the deflector 33 and a loop will be formed as shown so that the length of cable between the first and second connectors 6, 6' is increased.

It is also possible to produce cable assemblies having a length of cable extending forwardly beyond the first connector 6 on the cable 4. A cable assembly of this type is produced by simply continuing the feeding operation after the cable has arrived at the installing station (FIG. 4) until the desired length of cable has been fed beyond the installing station and beyond the first connector.

FIGS. 3-9 are intended to illustrate the principles of the invention and do not show all of the operating modes. Alternative operating modes are described below which do not make use of the cable clamp 26.

A machine 34 for the practice of the invention, FIGS. 10-17, comprises a frame assembly having a horizontal frame plate 36, a horizontal support plate or base plate 44 mounted on the frame plate at the right-hand end thereof, and a vertical plate 42 which extends from the surface of the plate 44. The feed rolls 20, 20' are mounted above and below a horizontal support plate 40 over which the feed path extends from the cable guide 38. The lower feed roll 20' is journaled on an axis which is supported on a vertical plate 51 which is secured to the support plate 44. This feed roll has a pulley on its end which is coupled by a belt 46 to the output shaft 48 of a stepper motor 49 which is supported between two depending support plates 50. The upper feed roll 20 is journaled between spaced-apart arms 52 which are pivotally mounted on an axis 54 which is suitably supported on the frame assembly. The ends of the arms are pivotally connected to a coupling 56 on the end of a piston rod 58 of a piston-cylinder 60. The upper end of the cylinder is pivotally connected at 62 to a bracket 64 which is supported on the fixed vertical plate 42. During feeding intervals, the cylinder 60 is pressurized thereby to move the piston rod 58 downwardly and hold the upper feed roll 20 against the cable which is being fed. The feeding interval is controlled by a suitable microprocessor or other control means which controls the stepper motor 49.

The upper shearing blade 22 is slidably contained by a plate 74 against the surface of the upper portion of plate 42 and is coupled by a short link 66 to a lever 68 which is pivoted intermediate its ends to the plate 42. The right-hand end of the lever, as viewed in FIG. 13, is pivoted to the piston rod of a piston cylinder 70, 72 which is in turn pivoted at its lower end. When the cable is to be cut, the cylinder 72 is pressurized thereby to swing the link 68 in a counter-clockwise direction as viewed in FIG. 13 and move the movable shearing blade 22 downwardly. A yieldable support 76 is provided against the lower portion of plate 42 and is resiliently biased or supported by a spring 78. The support serves to support the cable while it is being sheared by the shearing blades 22, 22'. The fixed shearing blade 22' is supported on the upper surface of the base plate 44.

The installing station 30 comprises two cross-heads or rams 32, 32' which are located above and below the module which is positioned in the installing station. The rams 32, 32' are on the ends of piston rods 82 which extend from pneumatic cylinders 84. When the cylinders are pressurized, the rams 32, 32' move relatively towards each other and cause parts of the modules to compress the connector contained therein as will be described below.

The modules 24, 28 are essentially similar but differ in minor respects and the means used to move the modules along the cable feed path are not the same for the two modules. The modules are supported by a fixed guide rail 150 and a power screw 102, see FIG. 16.

Figure 12:
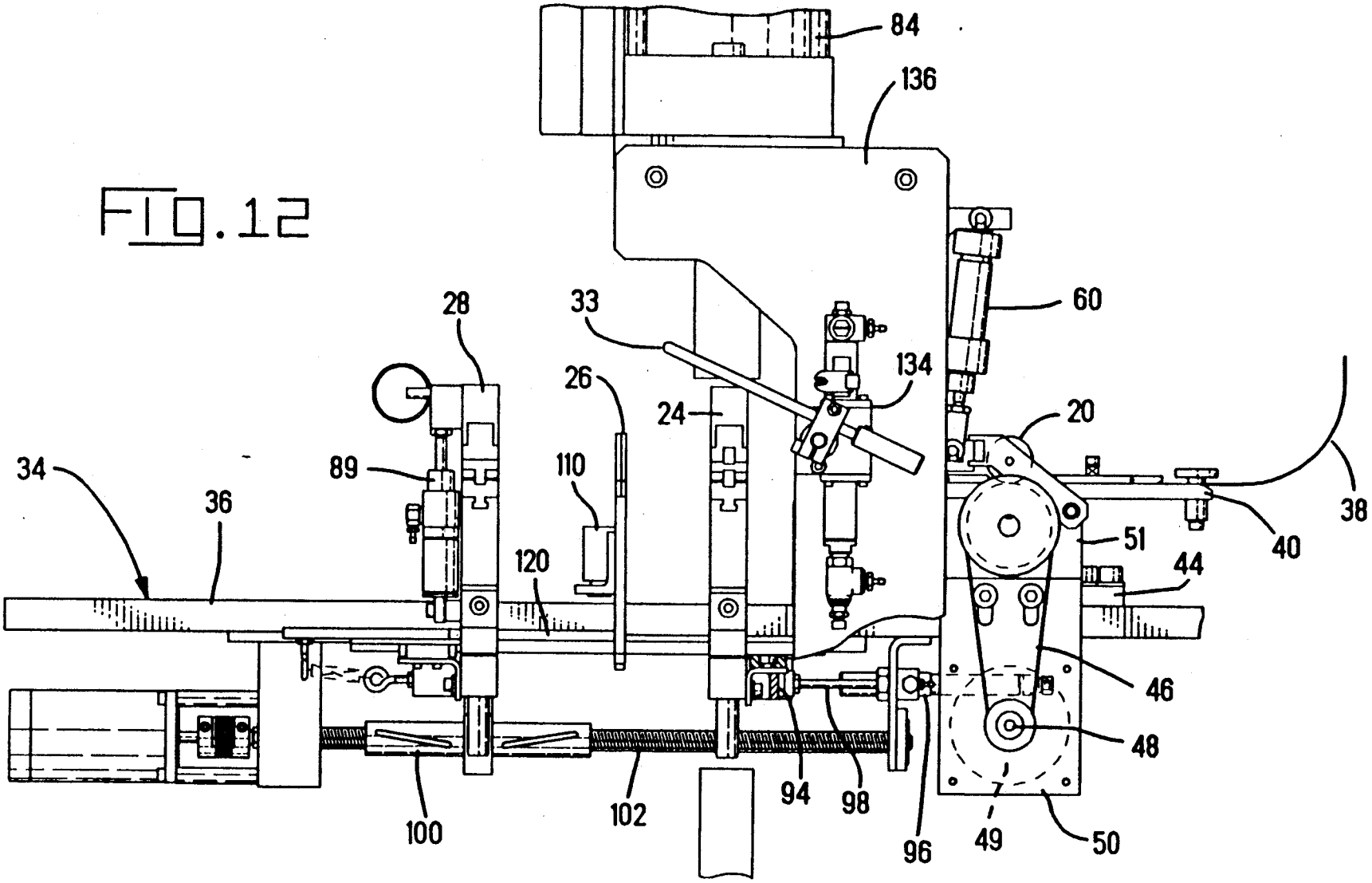
FIG. 12 is a view similar to FIG. 11 but showing the connector holders or modules and the cable clamp in downstream positions.
Figure 14:
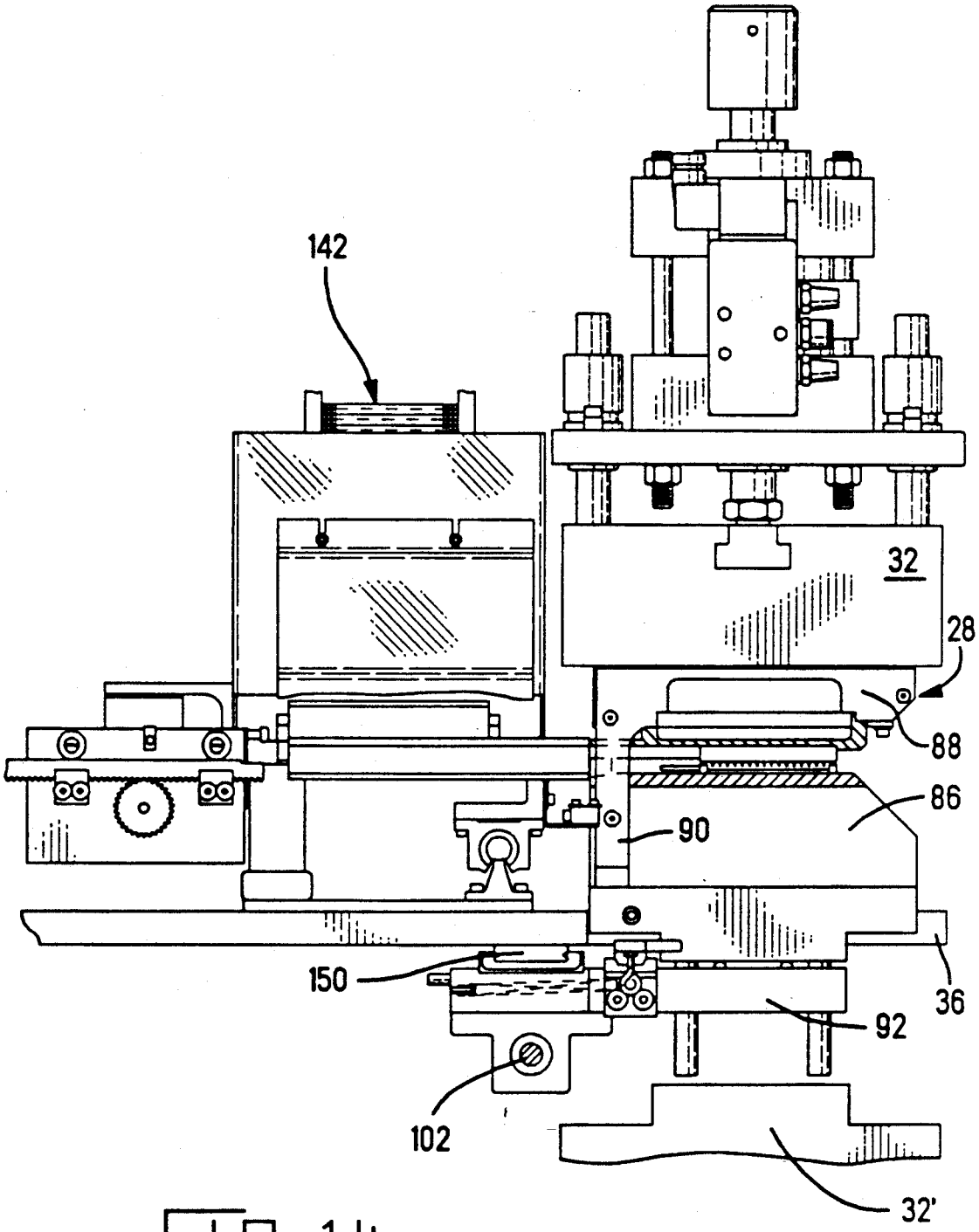

The first module 28, FIG. 14, comprises a fixed lower portion 86 and an upper portion 88 which is movable relatively towards and away from the lower portion. The upper portion 88 is guided by an arm 90 which is slidably received in guide surfaces in the lower portion. The connector is contained between the opposed surfaces of the two portions of the module which are contoured to precisely position it relative to the cable. The lower fixed portion 86 is supported on a base member 92 which in turn is suitably supported on rails as will be described below. Referring to FIG. 12, the base portion is moved from its upstream position, in which it is adjacent to the shearing blades 22, 22' to the position shown in FIG. 12 by means of a piston cylinder 98, 96 which is coupled to the base by a coupling 94. This piston cylinder is under the control of the microprocessor which controls all of the operations of the machine so that the module will be moved to the installing station at the appropriate time in the cycle.

Figure 16:
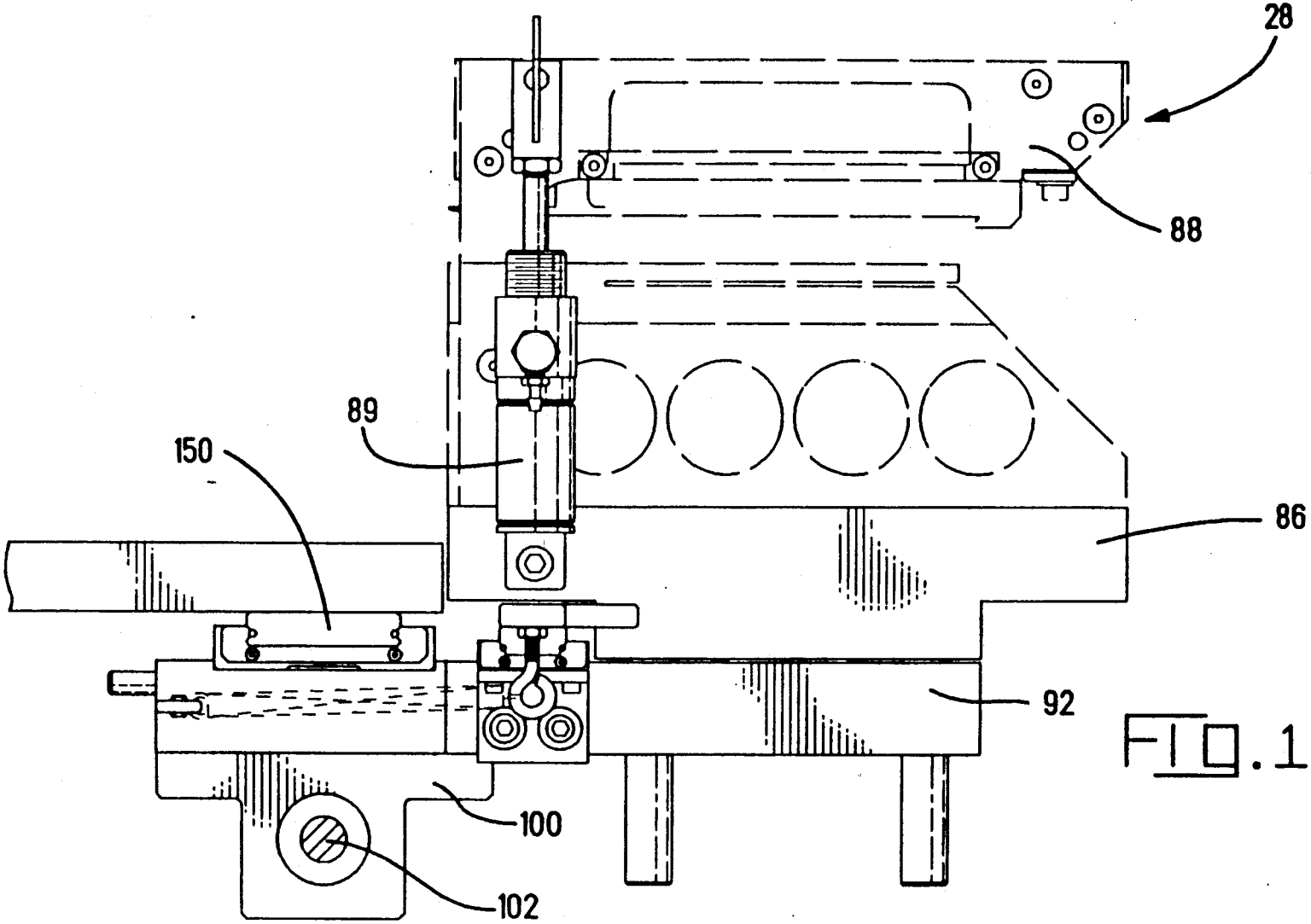

The first module 28 differs from the second module in that a piston cylinder 89 is provided as shown in FIG. 16 which holds the upper movable portion 88 in its lowered position against the force of the springs contained in the module which normally bias the upper portion to its raised position. It is desirable to hold the upper portion 88 in its lowered position during a portion of the operating cycle when the first module moves from the installing station to its downstream dwell location, FIG. 5. During this portion of the cycle, the cable is pulled by the connector in the module (which was previously installed on the end of the cable) and it is therefore necessary tightly to hold the connector while the stress is being imposed on the cable.

Figure 17:
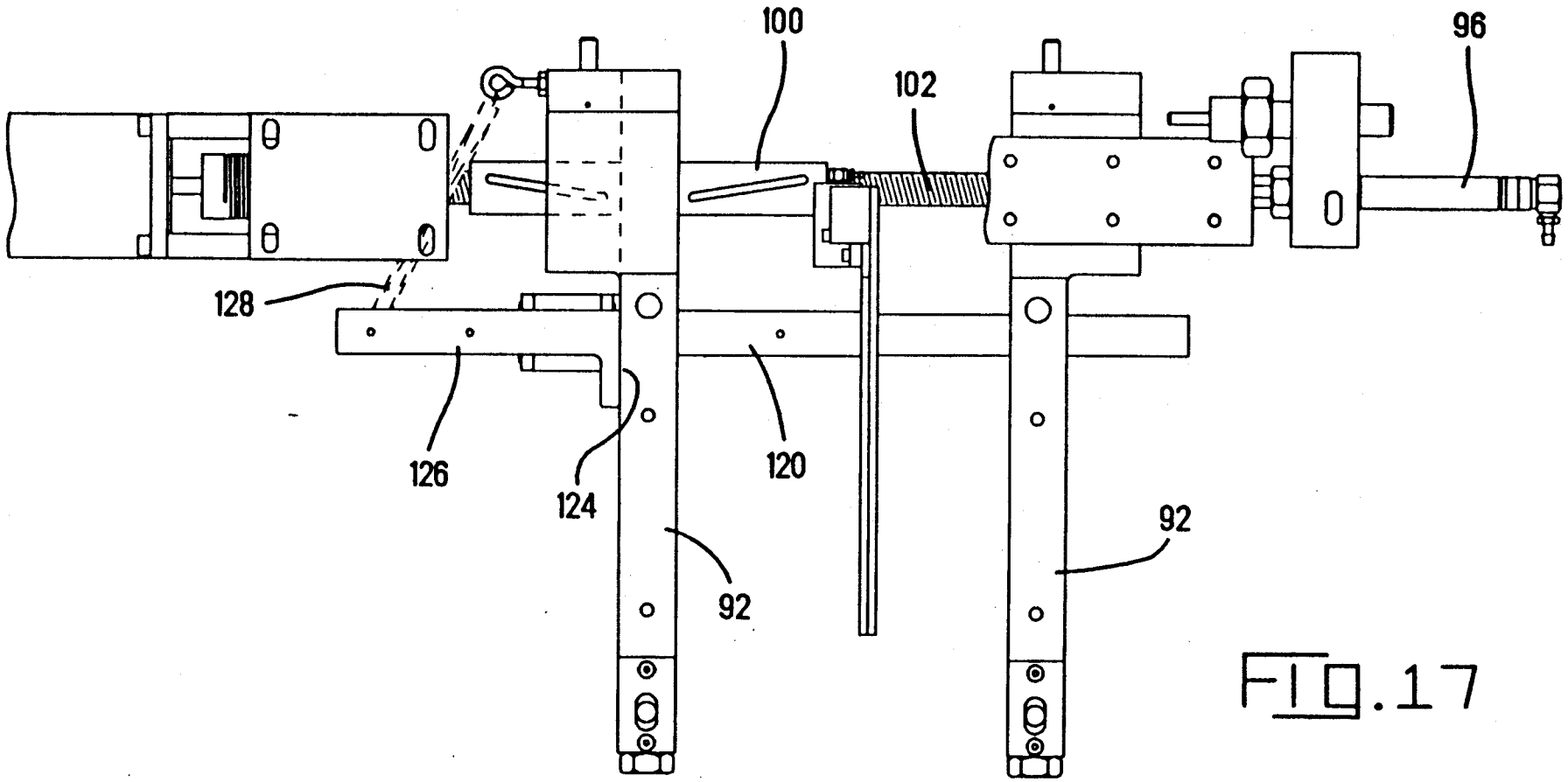

The first module is moved from the installing station to its downstream dwell location by a power screw 102 which is rotated by a motor 104. The first module is connected to a nut or follower 100 on the power screw by a coupling as shown in FIG. 17.

Figure 15:
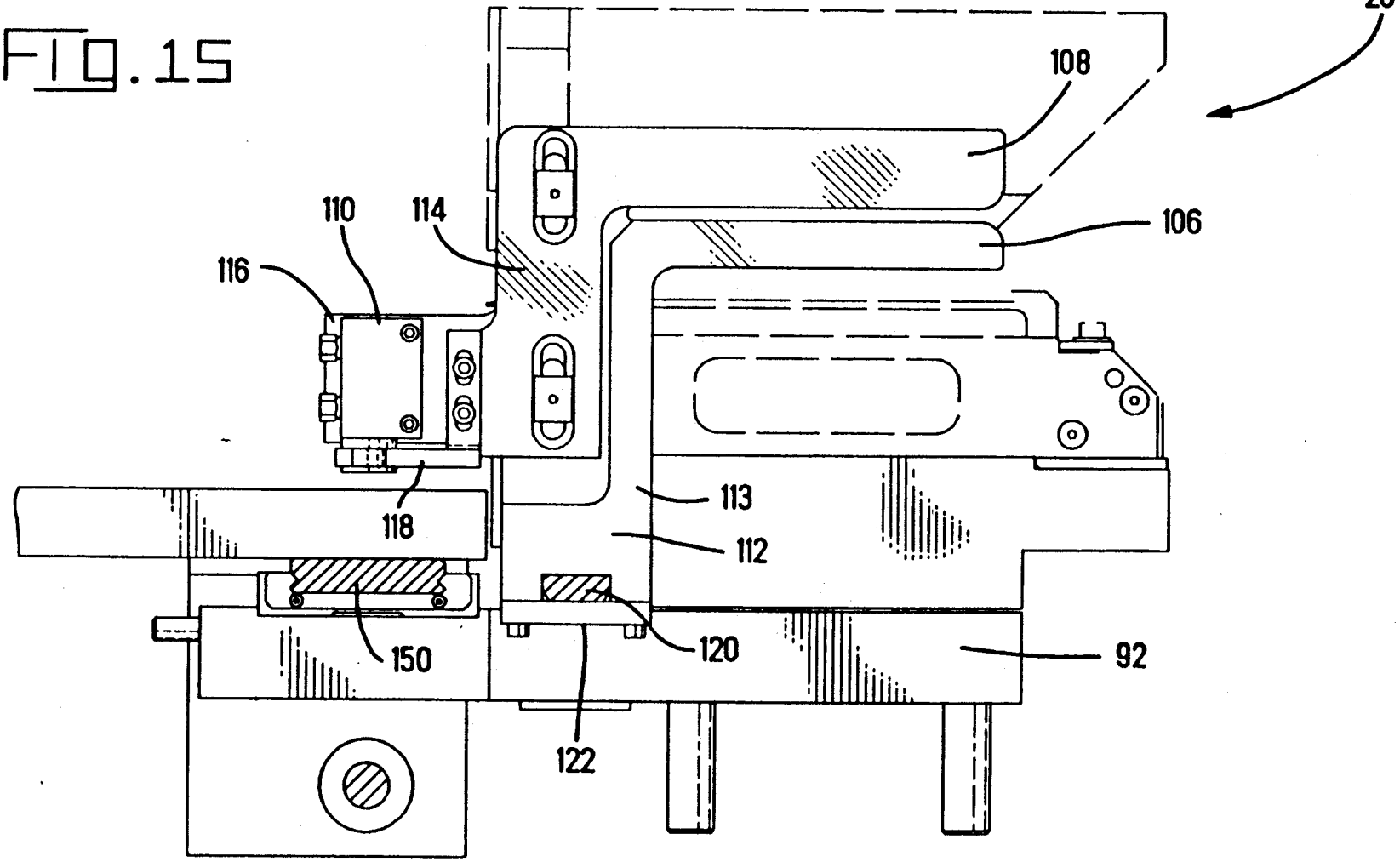

The cable clamp 26, FIG. 15, comprises lower and upper clamping arms 106, 108, the lower arm 106 being a fixed arm and the upper arm being movable between a raised and lowered position by means of a piston cylinder 110. The clamping assembly 26 is supported on a base which in turn is fixed to a link 120 and is coupled to the first module. The lower arm 106 has a vertical portion 113 and a base 112 is secured by a plate 122 to a link 120. The upper arm 108 has a vertically extending portion 114 which is slidably mounted in a recess in portion 113 and which has a bracket 118 thereon which is fixed to the piston rod of a piston cylinder 110 mounted on an ear 116 which extends from the vertical portion 113 of the fixed lower arm. The cylinder 110 is secured to the ear 116 so that pressurization of the cylinder 110 will cause downward movement of the piston rod and lowering of the upper arm 108 thereby to clamp the cable. The pressurization of the cylinder is controlled by the microprocessor.

The clamping assembly 26 is connected by a lost motion coupling to the first module 28 which comprises the elongated link 120 fixed to the base 112 of the lower arm 106. As shown in FIG. 17, this link extends beside the power screw 102 and past the first module. The link has a shoulder 124 in front of the first module. A spring 128 extends between the leading end 126 of the link 120 and the first module assembly so that the link is resiliently biased against the module assembly as shown in FIG. 17. When the parts are in the positions of FIG. 17, leftward movement of the first module assembly 28 will result in leftward movement of the clamping assembly 26.

If a relatively long cable assembly is to be produced, the deflector 33 is lowered as will be described below and additional cable is fed to form the loop shown in FIG. 9. The deflector 33 extends from an arm 130 which is pivoted on an actuator 134 that is mounted on a side plate 136. The actuator causes pivotal movement of the deflector between its deflecting position and its non-deflecting positions shown in FIG. 9. The actuator 134 is controlled by the microprocessor or other controlling device.

Figure 10:
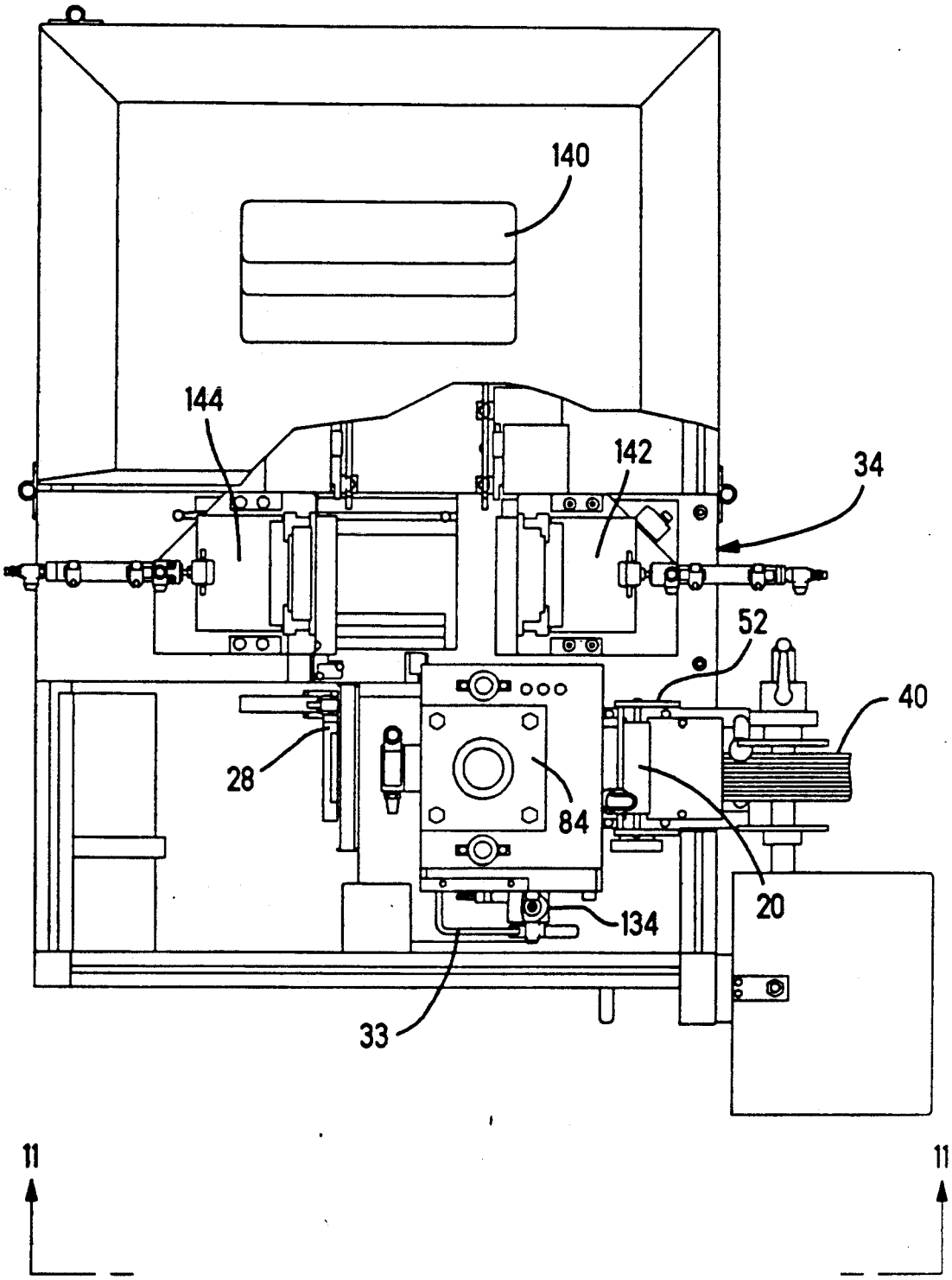
FIG. 10 is a top plan view of a machine in accordance with the invention.

The connector holders or modules 24, 28 can be loaded at the beginning of each operating cycle by hand but are, in the disclosed embodiment, loaded by loading mechanisms 142, 144 supported on a surface beside the cable feed path. The controller 140 is mounted on the same surface as shown in FIG. 10.

The operation of the disclosed embodiment will now be described with reference to FIGS. 10–17.

Figure 11:
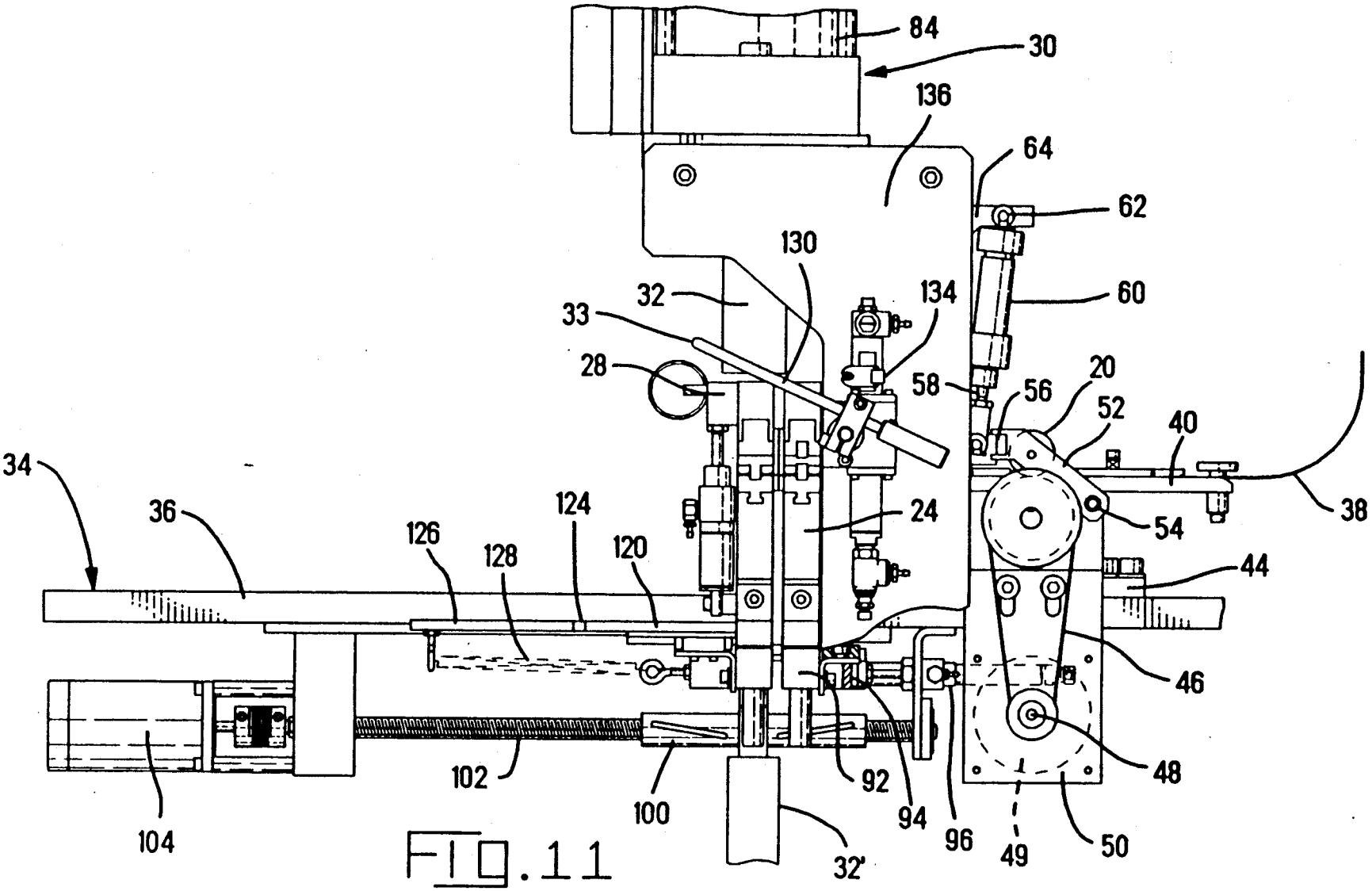
FIG. 11 is a side view looking in the direction of the arrows 11—11 of FIG. 10.

At the beginning of the operating cycle, the first and second connector holders or modules 24, 28 and the cable clamp 26 will be stacked against each other in the positions of FIG. 11 with the first module at the installing station 30 and with the clamp and second module upstream from the installing station. Connectors will have been loaded into the modules by the loading mechanisms and the cable will extend to the severing blades 22, 22'. The cable is fed to the first module if a cable assembly as shown in FIG. 1 is being produced which has a connector installed on each of its ends. If it is desired to produce a cable assembly having a portion of the cable extending beyond the first connector, the cable is fed until it extends beyond the connector in the first module. The connector contained in module 28 is installed on the cable and the first module 28 and the cable clamp 26 are then moved to the positions of FIG. 12. The second module is moved to the installing station, the cable is cut by severing blades 22, 22', and clamp 26 is closed. The first module or connector holder 24 is then moved downstream by the power screw 102 from the position of FIG. 12 by an amount equal to the distance between the cut end of the cable and the installing station 30. Movement of the first module results in movement of the clamp by the same distance by virture of the fact that the first module is against the shoulder 124 on link 120 and the clamp is thereby pulled in the downstream direction. The clamp, which is now closed into gripping relationship with the cable, pulls the cable downstream until the cut end is located in the connector 6' contained in the second module 24. The connector 6' is then installed on the cable and the cable assembly is ejected as shown in FIG. 8.

It is not essential to close the clamp when the machine is operated in the mode described above. If the clamp remains open, the cable will be pulled upon movement of the first module by virtue of the fact that the first connector 6 is installed on the cable. Whether or not the clamp is closed will depend upon the programming of the machine.

The foregoing explanation assumes that a relatively short cable assembly is being produced and that the deflector 33 is not put to use. If a longer cable assembly is being manufactured, the first module is moved downstream only a short distance from the position of FIG. 11 and the cable clamp and second module remain in the positions of FIG. 11. The deflector is lowered by swinging the arm 130 through an anti-clockwise arc and additional cable is fed as shown in FIG. 9, the deflector being downstream from (i.e., in front of) the clamp. The fact that the first module is coupled to the cable clamp by a lost motion coupling comprising the link 120 and shoulder 124 permits this movement of the first module independently of the clamp. After the additional cable has been fed to form the loop, the clamp is closed, the parts are moved to the positions of FIG. 12, the second connector is installed on the cable, and the finished cable assembly is ejected.

An extremely short cable assembly can be produced by moving the first connector holder a very short distance from the position of FIG. 11, cutting the cable, and thereafter moving the first connector holder downstream by the distance between the cutter blades and the installing station so that the cut end can be located in the second connector. When the machine is operated in this mode to produced extremely short cable assemblies, the cable clamp is never closed and the cable is pulled by the connector 6 when this the first connector holder is moved downstream.

It will be apparent from the foregoing description that a new result and significant advantages are obtained by the provision of the cable clamp and the deflector 33 as described herein.

I claim:

1. A machine for manufacturing electrical cable assemblies, each cable assembly comprising a plurality of electrical connectors which are installed on an electrical cable, the cable comprising a plurality of parallel side-by-side co-planar conductors, the machine comprising cable feeding means for feeding cable from an endless source along a cable feed path, cable severing means, a plurality of connector holders, and an installing station, the severing means and the connector installing station being on the feed path at fixed locations with the installing station downstream, relative to the direction of cable feeding, from the severing means, the connector holders being in alignment with each other on the feed path and being movable between upstream and downstream positions with respect to the installing station, the machine being characterized in that:

a normally open cable clamp is provided on the feed path between two adjacent connector holders, the cable clamp being movable between an upstream initial position and a downstream intermediate position with respect to the installing station, and the cable clamp is movable downstream from its downstream intermediate position to a downstream final position, the final position being spaced from the intermediate position by a distance equal to the distance between the severing means and the installing station whereby connectors in the connector holders can be installed on the cable by moving the connector holders in succession from their upstream positions to the installing station, and when the last connector holder is at the installing station, the severing means can be activated to cut the cable, and the cable clamp can be closed and moved to its downstream final position thereby to pull the cable in the downstream direction and locate the cut end of the cable in the connector which is in the last connector holder.

2. A machine as set forth in claim 1 characterized in that at least one cable deflector is provided at a location downstream from the installing station, the deflector being movable between a cable deflecting position and a non-deflecting position, the deflector being in deflective relationship to the cable feed path when in its deflecting position so that cable being fed by the feeding means is deflected laterally of the feed path whereby the length of cable between two adjacent connectors in the cable assembly is increased.

3. A machine as set forth in claim 1 characterized in that the machine has two connector holders.

4. A machine as set forth in claim 1 characterized in that the machine is intended for use with connectors of the type having a body portion and a cover member, the body portion having a cable receiving face which is opposed to the cover member, contact terminals having conductor receiving slots extending from the cable receiving face, the installing station comprising press means for pushing the cover member towards the cable receiving face and into assembled relationship with the body portion thereby to insert the conductors in a cable, which extends between the cover member and the body portion, into the conductor receiving slots.

5. A machine as set forth in claim 4 characterized in that each of the connector holders comprises a module which holds a connector body portion and a cover.

6. A machine for manufacturing electrical cable assemblies, each cable assembly comprising first and second electrical connectors which are installed on a flat electrical cable which comprises a plurality of parallel co-planar conductors, the machine comprising a connector installing station, first and second connector installing modules for containing a first connector and a second connector respectively, cable feeding means, and cable severing means, the installing station having press means for inserting the conductors in the cable into wire-receiving slots in terminals which are contained in the connectors, the cable feeding means being upstream, relative to the direction of cable feeding, from the connector installing station and being effective to feed the cable from an endless source along a cable feed path which extends through, and beyond, the installing station, the cable severing means being between the feeding means and the installing station, the first and second modules being on the feed path with the first module downstream from the second module, and module moving means are provided for moving each of the modules along the feed path, the machine being characterized in that:

a cable clamp is provided on the feed path between the first and second modules, the first module is movable between the installing station and a first module dwell location which is downstream from the installing station, the second module is movable between the installing station and a second module dwell location which is upstream from installing station, and the cable clamp is movable downstream along the feed path from an upstream initial position to an intermediate position and downstream to a final position, the initial position being upstream from the installing station, the intermediate and final positions being downstream from the installing station, the distance between the intermediate position and the final position being substantially equal to the distance between the severing means and the installing station whereby, upon placement of the first and second connectors in the first and second modules, movement of the second module to the second module dwell location, movement of the cable clamp to its initial position, movement of the first module to the installing station, feeding cable through the second module, through the cable clamp and at least to the first module, the first connector can be installed on the cable by the press means, and upon movement of the first module to the first module dwell location, movement of the clamp to its intermediate position, movement of the second module to the installing station, closing the cable clamp, cutting the cable, and moving the cable clamp to its final position, the cut end of the cable is positioned in the second connector so that the second connector is installed on the trailing end of the cable.

7. A machine as set forth in claim 6 characterized in that a cable deflector is provided on the feed path at a location downstream from, and adjacent to, the installing station, the deflector being movable between a deflecting position and a non-deflecting position, the deflector being in deflective relationship to the cable feed path when in its deflecting position so that cable fed by the feeding means is deflected laterally of the feed path whereby the length of cable between the first and second connectors in the cable assembly is increased.

8. A machine as set forth in claim 7 characterized in that the deflector comprises a deflector bar which is located beside the feed path, the deflector bar extending obliquely away from the feed path when in its non-deflecting position and extending across the feed path when in its deflecting position.

9. A machine as set forth in claim 6 characterized in that controlling means are provided for the feeding means, the controlling means being effective to feed cable beyond the installing station when the first module is at the installing station and prior to installation of the first connector on the cable whereby, cable assemblies can be made having cable portions which extend through, and beyond, the first connector.

10. A machine as set forth in any one of claims 6, 7, 8, or 9 characterized in that the cable clamp comprises a pair of clamping arms which extend across the feed path, the arms being spaced apart when the clamp is open and being substantially against each other when the clamp is closed, the feed path extending between the clamping arms.

11. A method of manufacturing electrical cable assemblies, each cable assembly comprising first and second electrical connectors which are installed on an electrical cable which comprises a plurality of co-planar parallel conductors, the method comprising the steps of:

feeding the cable from an endless source along a cable feed path which extends through the second connector, through an open cable clamp, and into the first connector which is positioned in a stationary connector applicator, installing the first connector on the cable by means of the connector applicator, moving the first connector downstream, relative to the direction of cable feeding, to a first connector dwell location while supplying cable from the source so that the cable is advanced through the second connector and past the connector applicator, moving the open cable clamp downstream along the cable feed path to a cable clamp dwell location which is between the first connector and the connector applicator, moving the second connector downstream along the cable feed path to the connector applicator, closing the cable clamp onto the cable, severing the cable at a location between the connector applicator and the cable source, moving the cable clamp downstream by an amount which will pull the cut end of the cable into the second connector, and installing the second connector on the severed end of the cable by means of the cable applicator.

12. The method set forth in claim 11 characterized in that after the first connector has been moved to the first connector dwell location, additional cable is fed from the endless source so that a loop is produced between the first connector and the cable clamp, and the length of the completed cable assembly is thereby increased.

13. The method set forth in either of claims 11 or 12 characterized in that the first connector and the cable clamp are moved in unison downstream from their dwell locations.

14. The method set forth in claim 11 including the step of feeding cable through and beyond the first connector when the first connector is positioned in the connector applicator thereby to produce a cable assembly having a portion of the cable extending through, and beyond, the first connector.

* * * * *